US005271504A

United States Patent [19]

Bowen et al.

[11] Patent Number: 5,271,504

[45] Date of Patent: Dec. 21, 1993

[54] SIFTER AND METHOD OF SIFTING

[75] Inventors: Charles T. Bowen, Lawrenceburg, Ind.; Eduard X. J. Janssens, Wolvertem, Belgium

[73] Assignee: Sweco, Incorporated, Florence, Ky.

[21] Appl. No.: 873,324

[22] Filed: Apr. 24, 1992

[51] Int. Cl.[5] ..... B07B 1/28

[52] U.S. Cl. ..... 209/316; 209/320

[58] Field of Search ..... 209/311, 315, 316, 317, 209/320, 322, 325, 346, 403, 254

[56] References Cited

U.S. PATENT DOCUMENTS

| | | | |
|---|---|---|---|
| 2,598,199 | 5/1952 | Vissac | 209/316 |
| 3,616,906 | 11/1971 | Miller | 209/315 |
| 4,576,713 | 3/1986 | Melin | 209/316 |

OTHER PUBLICATIONS

Kason Bulletin BT 84, "Blo-Thru" sifter from Kason, 4 pages.

Fluidizer brochure, A Subsidiary of General Resource Corp., Vibra-Flow In-Line Pneumatic Sifter, 2 pages.

Advantages of the Gump In-Line Pressure Sifter brochure, 4 pages.

Gump users manual, pp. 2-27.

*Primary Examiner*—Robert P. Olszewski
*Assistant Examiner*—Kenneth Noland
*Attorney, Agent, or Firm*—Lyon & Lyon

[57] ABSTRACT

A sifter having a resiliently mounted housing with horizontal vibrated screens. Airborne material to be sifted is introduced between the screens where it is deflected by a deflector and a breaker ring to distribute material both upwardly and downwardly to the screens. An external passage from above the upper screen conveys air and material to a discharge pipe below the lower screen and below a bottom pan which feeds into the distribution pipe. An extended passage for discharging oversize material from between the screens is open along its length to the lower screen. A weir at the inlet of the extended passage has a thin slit below and a larger hole above to allow material under certain conditions to flow into the outlet passage.

41 Claims, 7 Drawing Sheets

SIFTER AND METHOD OF SIFTING

BACKGROUND OF THE INVENTION

The field of the present invention is the sifting of airborne materials.

In the handling of fine materials such as flour, pneumatic conveying is often employed. Additionally, sifting is customarily performed on such materials during processing to remove foreign debris and to insure proper size distribution of the material itself. Centrifugal and round horizontal sifters are commonly used in such operations. Typically centrifugal type separators are employed with the lower capacity applications while horizontal separators are used for higher flow rates of air entrained material.

With horizontal separators, sifting occurs through screens mounted in a closed housing. The screens are vibrated to improve efficiency. Preferred screening conditions are understood to be achieved when the conveying air is reduced in velocity. With decreased turbulence, the material is allowed to settle on a screen and pass therethrough. To accomplish this, the cross-sectional area of flow must be increased substantially within the sifter. Because of the pneumatic conveyance and the closed nature of such housings, accommodation of overpressure must also be considered.

A relatively simple system has been practiced which employs a vibrated horizontal sifter screen with no air bypass. Airborne material is presented to the sifting chamber. The chamber is substantially larger in cross section than the conveying passage leading thereto. Consequently, velocities are reduced substantially. However, flow of both the carrier air and material must pass through the vibrating screen. Such devices are relatively inexpensive, are easy to service with easy disassembly and reassembly, are relatively small and require a minimum of dynamic forces for vibration. However, such devices are subject to overpressure which can cause screen damage and potentially less efficient screening.

A means for avoiding such overpressures includes devotion of a portion of the housing to air separation from the entrained material and bypass of that separated air. To accomplish such air bypass, the flow must be slowed very substantially to allow the entrained material to fall from the air flow. Once gravity separation has occurred, the air flowing through the housing is channeled around the sifting screens to where the sifted material may be reentrained and conveyed from the equipment. Such systems prevent the possibility of overpressure through use of the air bypass. However, increased size, complexity of disassembly and reassembly, cost and high dynamic forces compromise the bypass advantage.

SUMMARY OF THE INVENTION

The present invention is directed to sifters and methods for sifting which employ an upward as well as downward flow of airborne material to provide sifting of maximum utility.

In a first aspect of the present invention, airborne material is directed to between two horizontal screens. Located between the screens is a diffuser and a peripheral breaker ring which distribute and redirect the flow such that airborne material passes both upwardly and downwardly through the screens to accomplish sifting.

In another aspect of the present invention airborne material is distributed between horizontal screens. A manifold extending from the housing above the upper screen to the housing below the lower screen allows the flow through both screens to be recombined after passing through the screens without intruding upon the screen area within the housing itself.

In a further aspect of the present invention, oversize material collected between horizontal screens into which airborne material is to be sifted is conveyed through an extended passage to an oversize outlet. The extended passage is open to the lower screen and has an inlet with a weir positioned to define a small slit at the screen surface such that the oversize material may flow into the passageway. At the same time, a large opening is provided well above the screen in the event that material accumulation between screens becomes a problem.

In yet a further aspect of the present invention, a method of sifting airborne material is contemplated which provides for restricting flow of the airborne material to a lower screen while deflecting flow toward an upper screen. Optimum use of two spaced horizontal screens may thereby be achieved.

Accordingly, it is an object of the present invention to provide an improved sifter and sifting method. Other and further objects and advantages will appear hereinafter.

DETAILED DESCRIPTION OF THE PREFERRED EMBODIMENT

Figure 1:
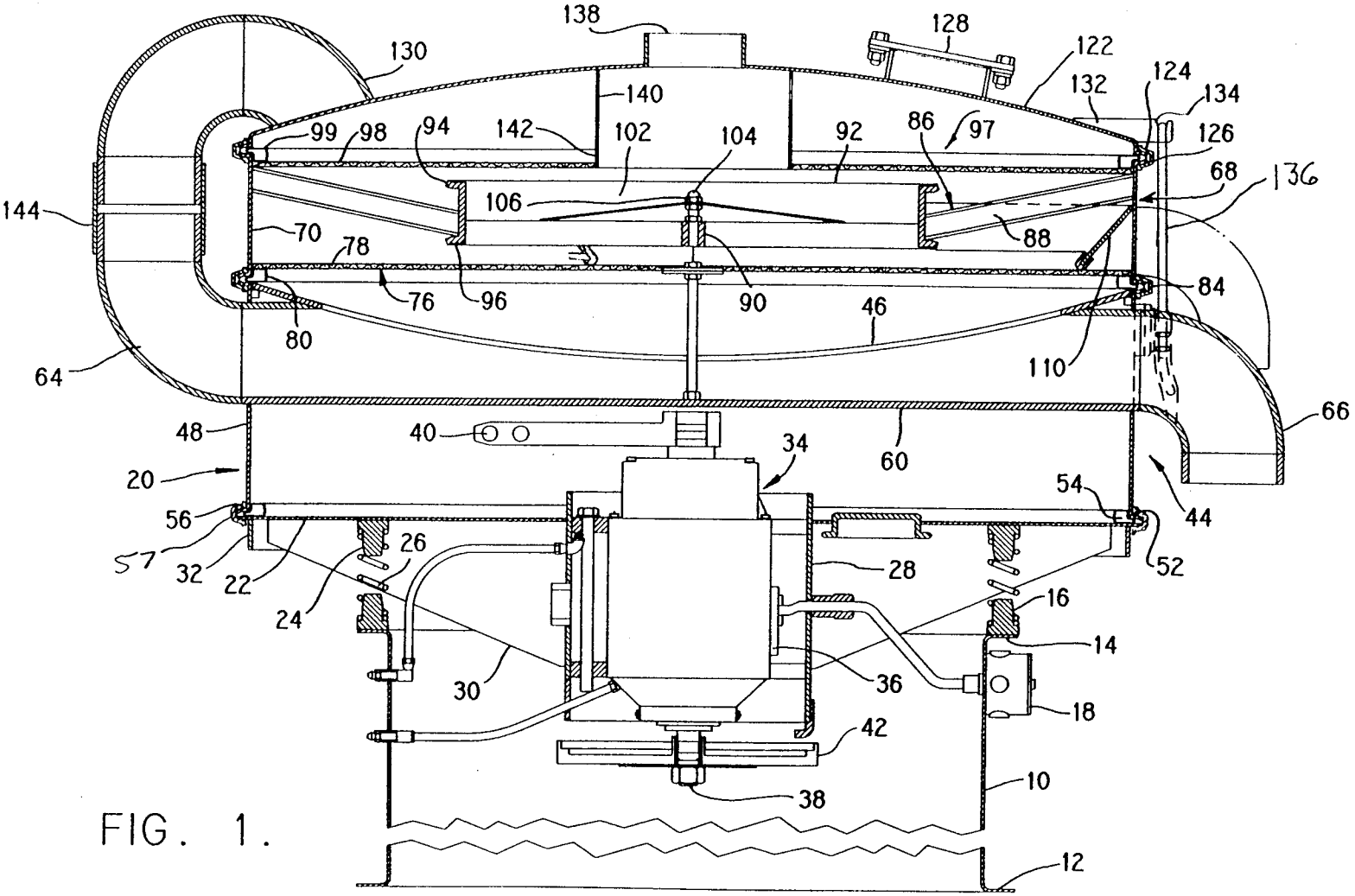
FIG. 1 is a cross-sectional elevational view of a sifter of the present invention.
Figure 2:
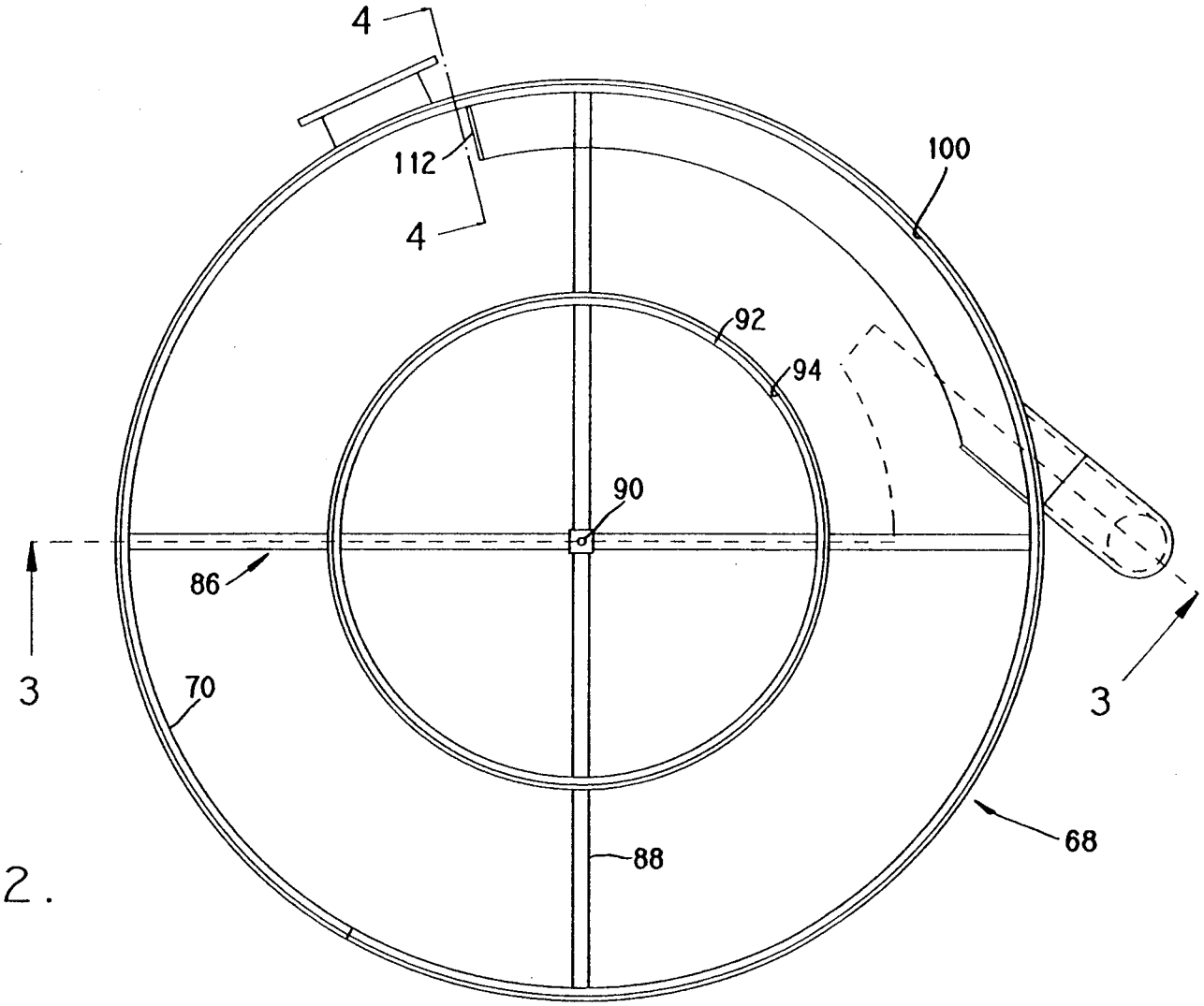
FIG. 2 is a plan view of the diffuser section of the device of FIG. 1.
Figure 3:
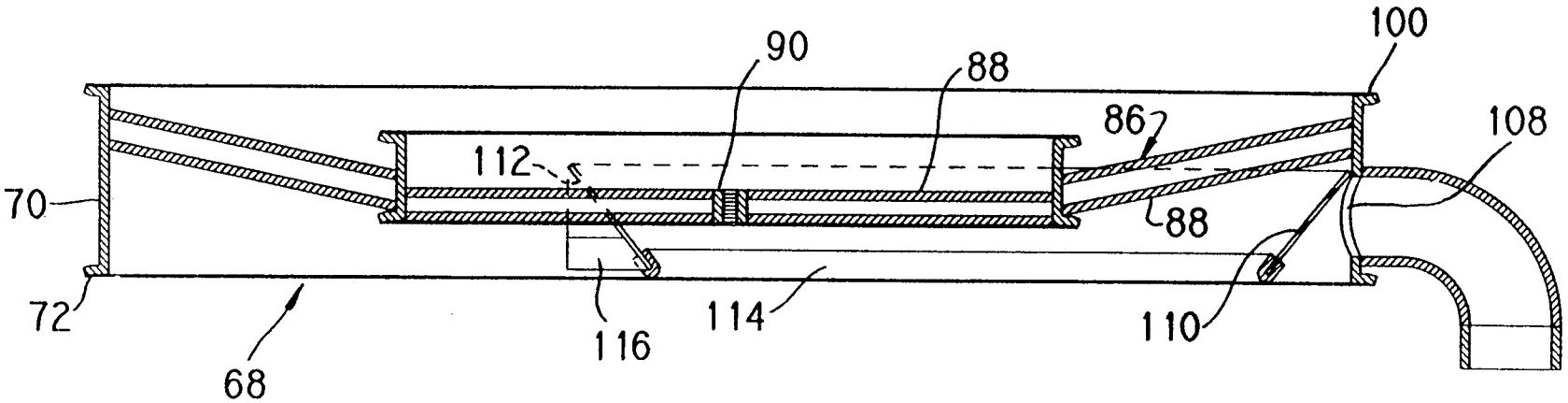
FIG. 3 is a cross-sectional elevational view of the section of FIG. 2 taken along line 3—3 of FIG. 2.
Figure 4:
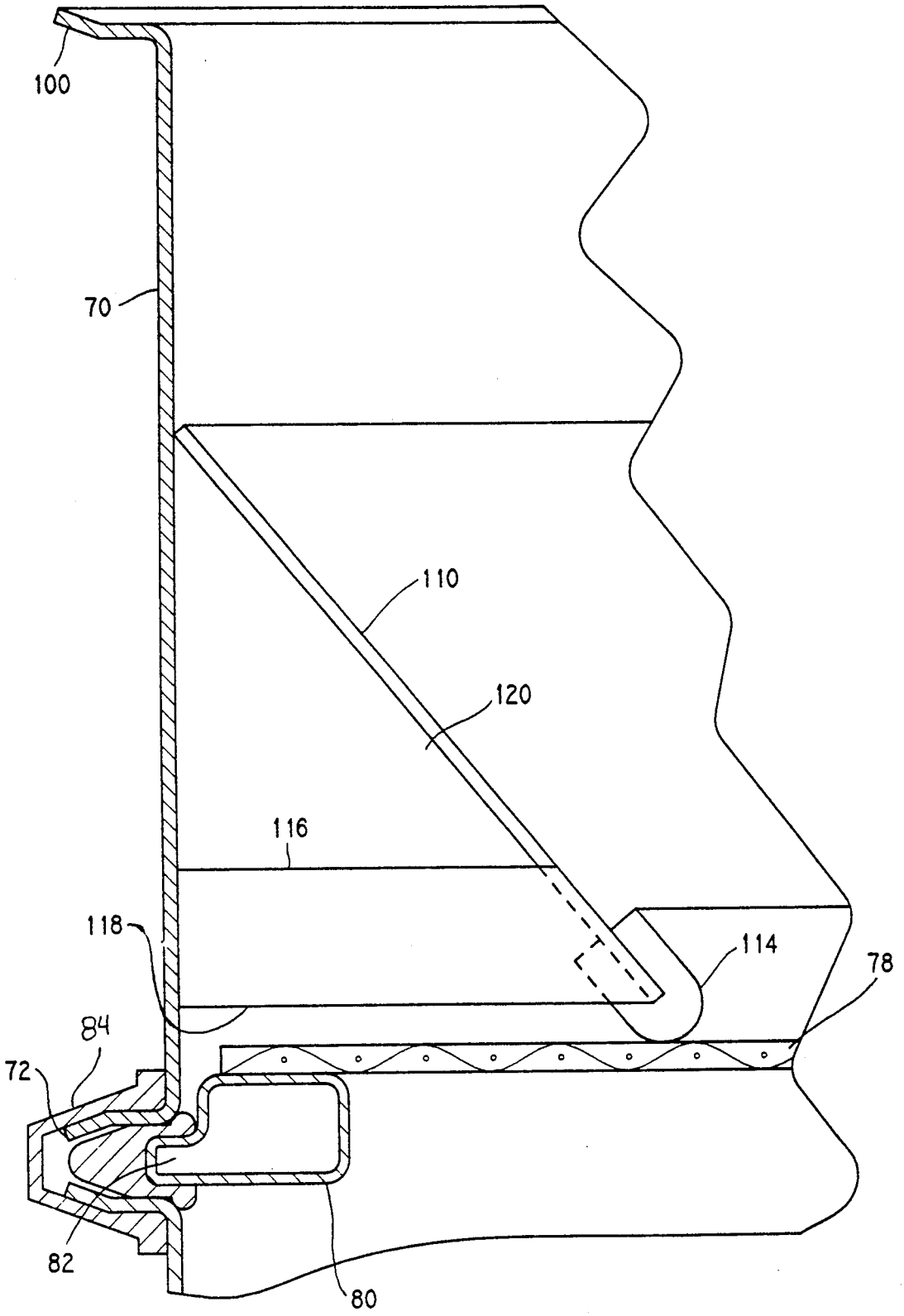
FIG. 4 is a cross-sectional detail taken along line 4—4 of FIG. 2.

Turning in detail to the drawings, FIG. 1 illustrates a sifting apparatus. A base 10 is conveniently circular in cross section and includes a base flange 12 and a mounting flange 14. The mounting flange 14 includes spring mounts 16. Other components requiring manipulation or external couplings when the device is vibrating are also mounted to the base. A J-box 18 and lubrication lines are illustrated.

Resiliently mounted on the base 10 is a housing, generally designated 20. The housing 20 includes a base plate 22. Spring mounts 24 are fixed to the underside of the base plate 22 to cooperate with the spring mounts 16 to retain mounting springs 26. Located centrally in the base plate 22 is a motor housing 28. The motor housing 28 is shown to be a cylindrical structure extending principally downwardly from the base plate 22. Gussets 30 are affixed to the underside of the base plate 22 and to the side of the motor housing 28. A circumferential ring 32 abuts against the outer ends of the gussets 30.

Before turning to the remainder of the housing 20, reference is made to the vibration generator, generally designated 34. The vibration generator 34 includes a motor 36 fixed to the motor housing 28. The motor 36 includes a vertically oriented shaft 38 which is coupled at its upper end to a first eccentric weight assembly 40 and at its lower end to a second eccentric weight assembly 42. The use of such a vibration generator 34 is well known in the art of separation and sifting.

Figure 5:
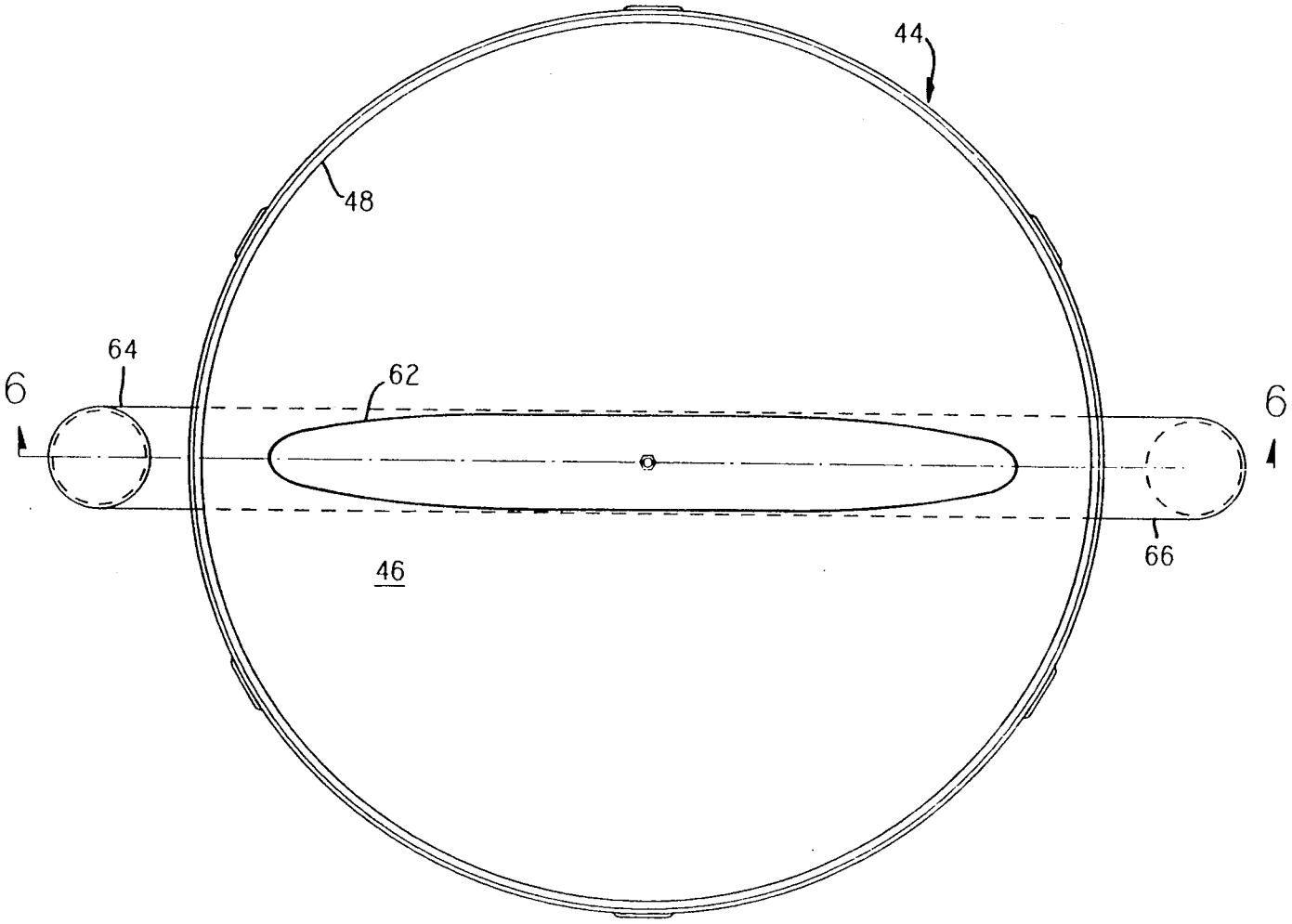
FIG. 5 is a plan view of a bottom pan section of the device of FIG. 1.
Figure 6:
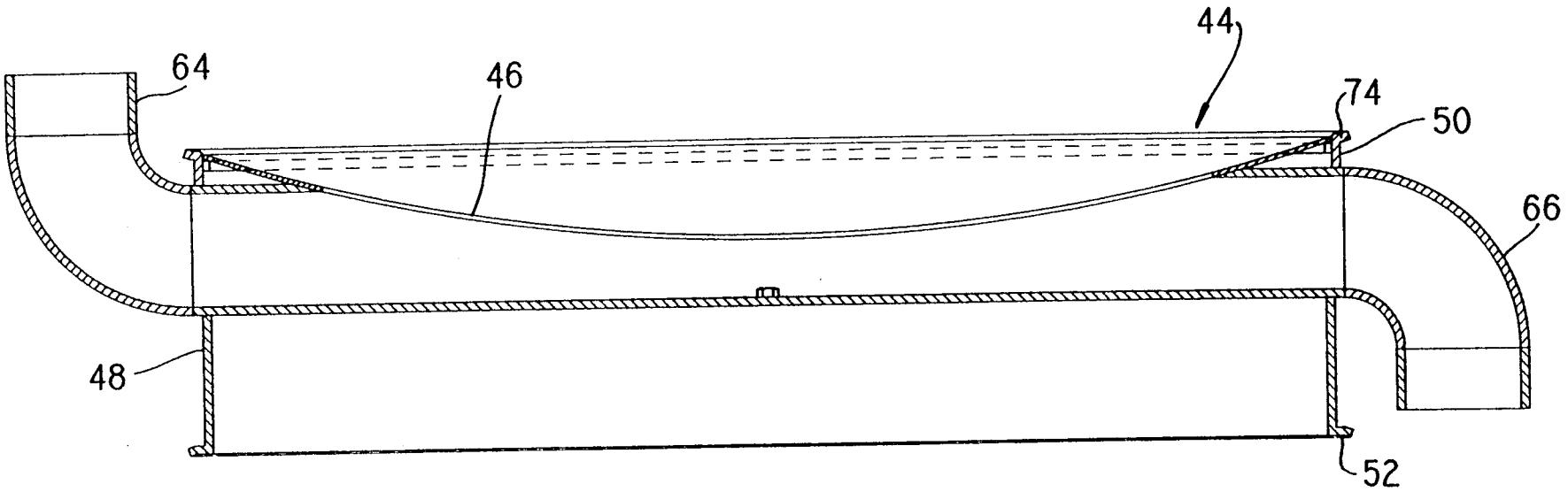
FIG. 6 is a cross-sectional elevational view of the section of FIG. 5 taken along line 6—6 of FIG. 5.
Figure 7:
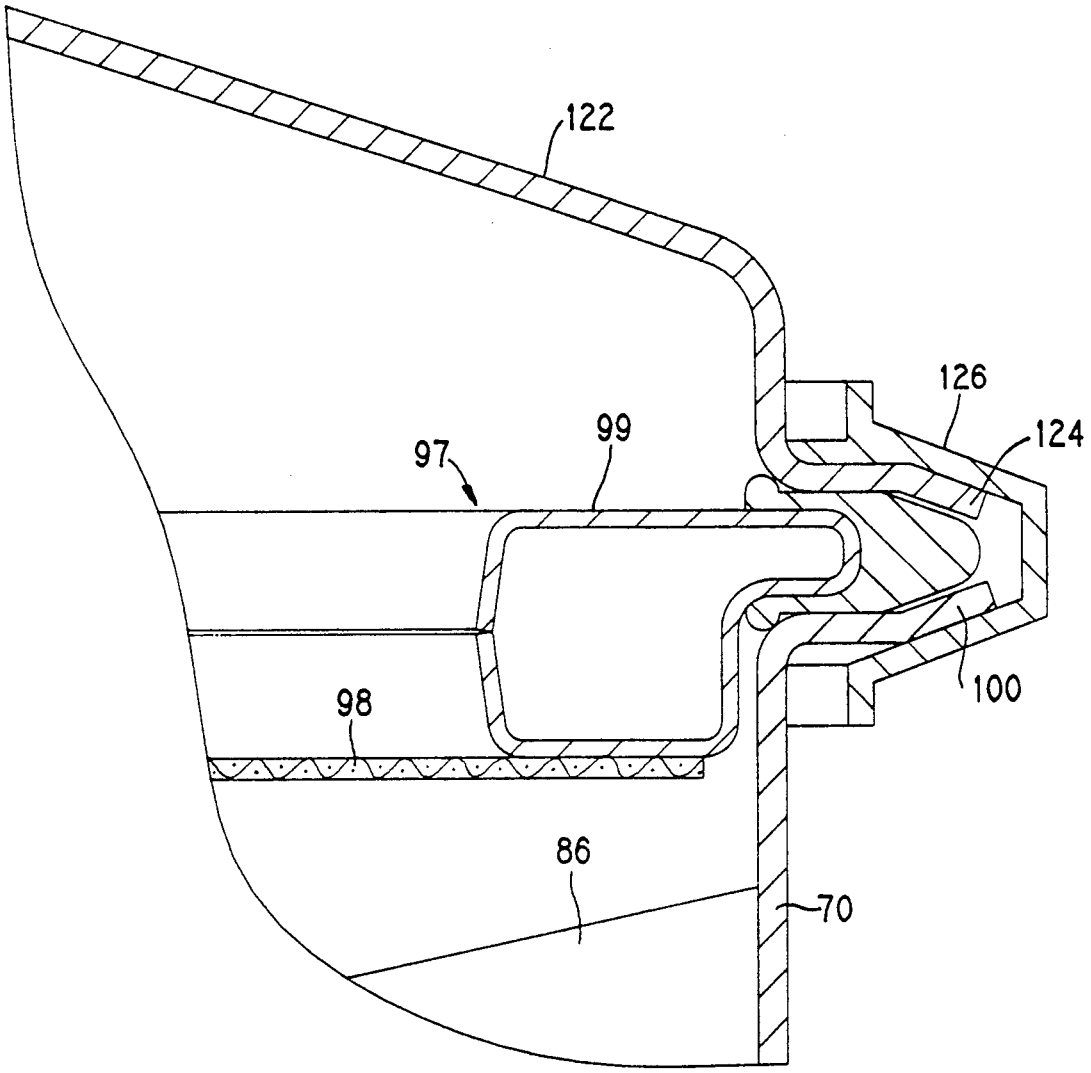
FIG. 7 is a cross-sectional elevation detail view of the joint between the top and sidewall of the device assembled as in FIG. 1.

Positioned on the base plate 22 is a bottom pan assembly, generally designated 44. This device is best illustrated in FIGS. 5 and 6 and includes a downwardly sloped bottom pan 46, which, in the preferred embodiment, is symmetrically dished. Also, a cylindrical housing section 48 supports the bottom pan 46 about its periphery by means of rectangular bar stock 50 which has been rolled and welded within the cylindrical housing section 48 to receive the bottom pan 46. The bottom pan is also welded to the stock 50. The cylindrical housing section 48 has a mounting flange 52 about its lower edge. This mounting flange 52 is associated with the outer periphery of the base plate 22. A screen frame 54 having an outwardly extending flange 56 is positioned between the mounting flange 52 and the base plate 22. A clamp band 57 is then positioned about the assembly and tensioned to lock the bottom pan assembly 44 to the base plate 22.

Extending across the housing 20 below the bottom pan is a discharge. The discharge includes a discharge passage 60 which may be a simple pipe welded to the bottom pan 46. The bottom pan 46 and the discharge passage 60 are assembled to intersect and a discharge hole 62 is cut through the bottom pan 46 as well as the discharge passage 60 to allow downward communication from the pan to the passage. The discharge further includes a first elbow 64 curved upwardly at one end of the discharge passage 60 and a second elbow 66 at the other end of the discharge passage 60 curved downwardly as a discharge port.

Mounted above the bottom pan assembly 44 to form a portion of the housing 20 with the bottom pan assembly 44 is a distribution assembly, generally designated 68. The distribution assembly 68 also includes a cylindrical wall 70 having a mounting flange 72 which is associated with a mounting flange 74 on the upper edge of the cylindrical housing section 48. At this joint between the distribution assembly 68 and the bottom pan assembly 44, a sifting screen 76 is positioned which has a screen cloth 78 and a screen frame 80 with an outwardly extending flange 82. The flange extends between the mounting flange 72 and the mounting flange 74; and a clamp band 84 retains these elements together.

A frame, generally designated 86 is positioned within the cylindrical wall 70. The frame 86 is made of rectangular tubing 88 extending in perpendicular directions across the housing. A nut 90 is positioned at the intersection of the rectangular tubing members 88 of the frame 86. A cylindrical breaker ring 92 is concentrically arranged within the distribution assembly 68. The rectangular tubing 88 locates this breaker ring 92 in a suspended position spaced vertically between upper and lower limits of the cylindrical wall 70. The breaker ring 92 has an upper edge 94 and a lower edge 96. The lower edge 96 is displaced from the sifting screen 76 to form an annular opening therebetween. An upper sifting screen 97, having screen cloth 98 and a screen frame 99, is displaced upwardly from the upper edge 94 of the breaker ring 92 to define another annular opening.

The upper sifting screen 97 is associated with the housing in a manner similar to that of the lower sifting screen 76. The upper sifting screen 97 is inverted and associated with a mounting flange 100 on the upper edge of the cylindrical wall 70.

Centrally located within the distribution assembly 68 is a diffuser 102. The diffuser 102 is associated with the nut 90 by means of a bolt 104 having a locking nut 106. The diffuser is upwardly convex, forming a wide angle cone, circular about its periphery. The diffuser 102 at its periphery is displaced from the breaker ring 92 to form an annular passage therebetween.

Positioned in the cylindrical wall 70 is an oversize discharge. The oversize discharge includes an oversize discharge port 108, and an oversize discharge passage defined by an inclined plate 110 extending about a portion of the inner periphery of the cylindrical wall 70. The inclined plate 110 extends downwardly to near the lower sifting screen 76 so as to define a substantially triangular oversize discharge passage with the cylindrical wall 70. This passage extends from an inlet 112 to the oversize discharge port 108. The bottom of the oversize discharge passage is open to the sifting screen 76 along its length to allow for continued sifting of material in the passage. A gasket 114 extends between the inclined plate 110 and the lower sifting screen 76 to seal substantially the length of the passage from the main portion of the screen 76 outwardly of the gasket 114. At the inlet 112, a weir 116 is positioned to partially block the inlet. The weir provides a small slit 118 between the bottom of the weir 116 and the lower sifting screen 76. This slit 118 allows some passage of material laying on the lower sifting screen 76 to pass into the oversize discharge passage even though it may be appropriately sized to pass through the screen. A larger opening 120 is defined above the weir 116 to receive larger quantities of material in the event that material accumulates on the lower sifting screen 76.

Assembled as part of the housing 20 above the distribution assembly 68 is a top cover 122. The top cover 122 is associated with the cylindrical wall 70 through the mounting flange 100 o the cylindrical wall 70 and a mounting flange 124 on the top cover 122. The upper sifting screen frame 99 is positioned between the mounting flanges 100 and 124; and the assembly is held together by a clamp band 126.

The top cover 122 is substantially closed with a normally closed inspection port 128. An elbow 130 extends from the top cover 122 to a downward orientation. Clamp clip bars 132 are positioned about the top cover and each includes a notch 134 which may be associated with a tie bar 136 for fastening by an overcenter mechanism attached to the cylindrical housing section 48.

An inlet 138 extends through the top cover 122. Inwardly of the top cover 122 is an open expansion chamber 140 forming part of the inlet passage with the inlet 138. As the expansion chamber 140 is wider than the inlet 138, the inlet passage expands in cross section as it moves inwardly to the housing. The upper sifting screen 97 has a hole 142 therethrough and the expansion chamber 140 extends through that hole such that it is directed to the upper surface of the diffuser 102.

The first elbow 64 associated with the discharge passage 60 and the elbow 130 through the top cover 122 are aligned. In association with a pipe coupling 144, the elbows 64 and 130 define an external passage communicating the inside of the top cover 122 with the discharge passage 60.

In operation, airborne material is sifted by being downwardly conveyed through the inlet 138 into the expansion chamber 140 where the velocity of the flow is allowed to decrease. At the distribution port at the end of the inlet portion between the screens 76 and 97, the airborne material is released toward the diffuser 102. The diffuser deflects the material from its downward trajectory. Because of the configuration of the diffuser 102 and the breaker ring 92, continued flow downwardly is restricted. The annular passage between the outer periphery of the diffuser 102 and the inner wall of the breaker ring 92 results in flow upwardly toward the upper sifting screen 97. A portion of the flow continues to occur downwardly toward the lower sifting screen 76. These sifting screens 76 and 97 are vibrated along with the entire housing 20 to promote material flow therethrough.

Material settling from the air flow falls to the lower sifting screen 76. A depth of material can accumulate on the lower screen during sifting which tends to spread out over the screen as it moves under the influence of the vibrations in a circular pattern. The breaker ring 92 extends upwardly and downwardly to upper and lower edges 94 and 96, thus defining annular openings above and below the ring. This restricts to a certain extent airborne material flow outwardly of the breaker ring. Air flow with a reduced amount of material therein proceeds upwardly through the upper sifting cloth 98. As the area above the upper sifting screen 97 is not so confined as that within the breaker ring 92, a portion of the entrained material is allowed to fall back onto the upper sifting screen 98 outwardly of the breaker ring 92. This material may be screened back through the upper sifting screen 97 and fall on the lower sifting screen 76 where it is further sifted. The air and remaining entrained material found in the area above the upper sifting screen 97 passes through the external passage defined by the elbows 64 and 130 and the pipe coupling 144 to the discharge passage 60. Material sifted through the lower sifting screen 76 falls to the bottom pan 46 and through the discharge hole 62 into the discharge passage 60. Thus, the external passage and the discharge passage 60 with the hole 62 form a manifold for the processed air and airborne material to be accumulated in the passage 60. The flow of air then discharges the material through the discharge outlet at the second elbow 66.

The accumulation of material to be screened on the lower sifting screen 76 moves under the influence of the vibratory motion in an outwardly and circular fashion. Oversize material which cannot pass through the screen and material yet to be screened can accumulate on the lower sifting screen 76. This material can flow to the extended oversize discharge passage, meeting the weir 116. A manageable amount of material flows beneath the weir through the small slit 118. The remaining material is further processed in the main area between the upper and lower screens unless a sufficient accumulation of material results in material flowing over the weir 116 through the large opening 120. The material flowing through the small slit 118 then continues to ride along the lower sifting screen 76 where additional properly sized material will flow through the screen. The oversize material continues to move under the influence of the vibratory motion to the oversize discharge port 108 where it drops from the system. By having a container closed or restricted to air flow associated with the oversize discharge port 108, air flow does not become a factor in the operation of the oversize discharge system.

Accordingly, an improved sifting mechanism and method are provided by the foregoing embodiment. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A sifter comprising a resiliently mounted housing;

a vibration generator attached to said housing;

a first screen extending substantially horizontally across the interior of said housing;

a second screen extending substantially horizontally across the interior of said housing, spaced from and below said first screen;

an inlet passage extending downwardly into said housing through said first screen and having a distribution port between said first screen and said second screen;

a diffuser positioned between said first screen and said second screen in front of and spaced from said distribution port;

a breaker ring about the periphery of said diffuser and spaced therefrom to create an annular passage between said breaker ring and the periphery of said diffuser and positioned between said distribution port and said second screen.

2. The sifter of claim 1 wherein said diffuser is a wide angle cone having a circular periphery, the convex side of said cone facing upwardly.

3. The sifter of claim 2 wherein said breaker ring is cylindrical.

4. The sifter of claim 1 wherein said inlet passage expands in cross-sectional area toward said distribution port.

5. The sifter of claim 1 wherein said housing is closed, the sifter further comprising a discharge from below said second screen, a bypass passage from above said first screen to below said second screen and an oversize discharge between said first screen and said second screen.

6. The sifter of claim 1 further comprising an oversize discharge between said first screen and said second screen.

7. The sifter of claim 6 wherein said oversize discharge includes an oversize discharge port through said housing, an elongate path having a first opening between said first screen and said second screen and distant from said oversize discharge port and a second opening at said oversize discharge port, said elongate path being open along the length thereof to said second screen and being otherwise closed along the length thereof to said housing between said first screen and said second screen.

8. The sifter of claim 7 wherein said elongate path has a weir across said first opening having a small slit between said weir and said second screen and a larger opening above said weir into said elongate path.

9. A sifter comprising a resiliently mounted housing;

a vibration generator attached to said housing;

a first screen extending substantially horizontally across the interior of said housing;

a second screen extending substantially horizontally across the interior of said housing and spaced from and below said first screen;

an inlet passage extending downwardly into said housing through said first screen and having a distribution port between said first screen and said second screen;

a diffuser positioned between said first screen and said second screen in front of and spaced from said distribution port;

a breaker ring about the periphery of said diffuser and spaced therefrom to create an annular passage between said breaker ring and the periphery of said diffuser, said breaker ring having an upper edge and a lower edge, said upper edge of said breaker ring being spaced from said first screen to define a first annular opening therebetween and said lower edge of said breaker ring being spaced from said second screen to define a second annular opening therebetween.

10. The sifter of claim 9 wherein said diffuser is a wide angle cone having a circular periphery, the convex side of said cone facing upwardly.

11. The sifter of claim 10 wherein said breaker ring is cylindrical.

12. The sifter of claim 9 wherein said inlet passage expands in cross-sectional area toward said distribution port.

13. The sifter of claim 9 wherein said housing is closed, the sifter further comprising a discharge from below said second screen, a bypass passage from above said first screen to below said second screen and an oversize discharge between said first screen and said second screen.

14. The sifter of claim 9 further comprising an oversize discharge between said first screen and said second screen.

15. The sifter of claim 14 wherein said oversize discharge includes an oversize discharge port through said housing, an elongate path having a first opening between said first screen and said second screen and distant from said oversize discharge port and a second opening at said oversize discharge port, said elongate path being open along the length thereof to said second screen and being otherwise closed along the length thereof to said housing between said first screen and said second screen.

16. The sifter of claim 15 wherein said elongate path has a weir across said first opening having a small slit between said weir and said second screen and a larger opening above said weir into said elongate path.

17. A sifter comprising a resiliently mounted closed housing;

a vibration generator attached to said housing;

a first screen extending substantially horizontally across the interior of said housing;

a second screen extending substantially horizontally across the interior of said housing, spaced from and below said first screen;

an inlet passage extending downwardly into said housing through said first screen and having a distribution port between said first screen and said second screen;

a diffuser positioned between said first screen and said second screen in front of and spaced from said distribution port;

an external passage extending from said housing above said first screen to said housing below said second screen;

a discharge passage from said housing below said second screen and having a discharge port.

18. The sifter of claim 17 wherein said inlet passage expands in cross-sectional area toward said distribution port.

19. A sifter comprising a resiliently mounted closed housing;

a vibration generator attached to said housing;

a first screen extending substantially horizontally across the interior of said housing;

a second screen extending substantially horizontally across the interior of said housing, spaced from and below said first screen;

an inlet passage extending downwardly into said housing through said first screen and having a distribution port between said first screen and said second screen;

a diffuser positioned between said first screen and said second screen in front of and spaced from said distribution port wherein said diffuser is a wide angle cone having a circular periphery, the convex side of said cone facing upwardly;

an external passage extending from said housing above said first screen to said housing below said second screen;

a discharge passage from said housing below said second screen and having a discharge port.

20. The sifter of claim 19 further comprising a breaker ring about the periphery of said diffuser and spaced therefrom to create an annular passage between said breaker ring and the periphery of said diffuser, said breaker ring being cylindrical.

21. A sifter comprising a resiliently mounted closed housing having a downwardly sloped bottom pan;

a vibration generator attached to said housing;

a first screen extending substantially horizontally across the interior of said housing;

a second screen extending substantially horizontally across the interior of said housing, spaced from and below said first screen;

an inlet passage extending downwardly into said housing through said first screen and having a distribution port between said first screen and said second screen;

a diffuser positioned between said first screen and said second screen in front of and spaced from said distribution port;

an external passage extending from said housing above said first screen to said housing below said second screen;

a discharge passage from said housing below said second screen and having a discharge port;

wherein said discharge passage extends across said housing below said bottom pan and said bottom pan includes a hole intersecting said discharge passage between said external passage and said discharge port.

22. A sifter comprising a resiliently mounted closed housing;

a vibration generator attached to said housing;

a first screen extending substantially horizontally across the interior of said housing;

a second screen extending substantially horizontally across the interior of said housing, spaced from and below said first screen;

an inlet passage extending downwardly into said housing through said first screen and having a distribution port between said first screen and said second screen;

a diffuser positioned between said first screen and said second screen in front of and spaced from said distribution port;

an external passage ext ending from said housing above said first screen to said housing below said second screen;

a discharge passage from said housing below said second screen and having a discharge port; and an oversize discharge between said first screen and said second screen.

23. The sifter of claim 22 wherein said oversize discharge includes an oversize discharge port through said housing, an elongate path having a first opening between said first screen and said second screen and distant from said oversize discharge port and a second opening at said oversize discharge port, said elongate path being open along the length thereof to said second screen and being otherwise closed along the length thereof to said housing between said first screen and said second screen.

24. The sifter of claim 23 wherein said elongate path has a weir across said first opening having a small slit between said weir and said second screen and a larger opening above said weir into said elongate path.

25. A sifter comprising a resiliently mounted closed housing having a downwardly sloped bottom pan;

a vibration generator attached to said housing;

a first screen extending substantially horizontally across the interior of said housing;

a second screen extending substantially horizontally across the interior of said housing, spaced from and below said first screen and above said bottom pan;

an inlet passage extending downwardly into said housing through said first screen and having a distribution port between said first screen and said second screen directed toward said second screen;

an external passage extending from said housing above said first screen to said housing below said second screen;

a discharge passage extending across said housing below said second screen and having a discharge port from said housing at one end of said discharge passage, said external passage extending to the other end of said discharge passage, said bottom pan including an opening downwardly into said discharge passage.

26. The sifter of claim 25 wherein said bottom pan is downwardly dished

27. The sifter of claim 26 wherein said discharge passage extends across said housing below said bottom pan and said bottom pan includes a central hole intersecting said discharge passage between said bypass passage and said discharge port.

28. The sifter of claim 25 further comprising a diffuser positioned between said first screen and said second screen in front of and spaced from said distribution port.

29. The sifter of claim 28 further comprising a breaker ring about the periphery of said diffuser and spaced therefrom to create an annular passage between said breaker ring and the periphery of said diffuser and positioned between said distribution port and said second screen.

30. The sifter of claim 25 further comprising an oversize discharge between said first screen and said second screen.

31. The sifter of claim 30 wherein said oversize discharge includes an oversize discharge port through said housing, an elongate path having a first opening between said first screen and said second screen and distant from said oversize discharge port and a second opening at said oversize discharge port, said elongate path being open along the length thereof to said second screen and being otherwise closed along the length thereof to said housing between said first screen and said second screen.

32. The sifter of claim 31 wherein said elongate path has a weir across said first opening having a small slit between said weir and said second screen and a larger opening above said weir into said elongate path.

33. The sifter of claim 25 further comprising a diffuser positioned between said first screen and said second screen in front of and spaced from said distribution port, said diffuser being a wide angle cone having a circular periphery, the convex side of said cone facing upwardly.

34. The sifter of claim 33 further comprising a breaker ring about the periphery of said diffuser and spaced therefrom to create an annular passage between said breaker ring and the periphery of said diffuser, said breaker ring being cylindrical.

35. The sifter of claim 25 wherein said inlet passage expands in cross-sectional area toward said distribution port.

36. A sifter comprising a resiliently mounted closed housing having a downwardly dished bottom pan;

a vibration generator attached to said housing;

a first screen extending substantially horizontally across the interior of said housing;

a second screen extending across the interior of said housing substantially parallel to said first screen and spaced from and below said first screen and above said bottom pan;

an inlet passage extending downwardly into said housing through said first screen and having a distribution port between said first screen and said second screen directed toward said second screen, said inlet passage expanding in cross-sectional area toward said distribution port;

a diffuser positioned between said first screen and said second screen in front of and spaced from said distribution port;

a cylindrical breaker ring about the periphery of said diffuser and spaced therefrom to create an annular passage between said breaker ring and the periphery of said diffuser, said cylindrical breaker ring having an upper edge and a lower edge, said upper edge of said breaker ring being spaced from said first screen to define a first annular opening therebetween and said lower edge of said breaker ring being spaced from said second screen to define a second annular opening therebetween;

an external passage extending from said housing above said first screen to said housing below said second screen;

a discharge passage extending across said housing below said second screen and having a discharge port from said housing at one end of said discharge passage, said bypass passage extending to the other end of said discharge passage, said bottom pan including an opening downwardly into said discharge passage.

37. The sifter of claim 36 wherein said discharge passage extends across said housing below said bottom pan and said bottom pan includes a central hole intersecting said discharge passage between said external passage and said discharge port.

38. The sifter of claim 36 further comprising an oversize discharge between said first screen and said second screen.

39. The sifter of claim 38 wherein said oversize discharge includes an oversize discharge port through said housing, an elongate path having a first opening between said first screen and said second screen and distant from said oversize discharge port and a second opening at said oversize discharge port, said elongate path being open along the length thereof to said second screen and being otherwise closed along the length thereof to said housing between said first screen and said second screen.

40. The sifter of claim 36 wherein said diffuser is a wide angle cone having a circular periphery, the convex side of said cone facing upwardly.

41. The sifter of claim 36 wherein said discharge passage extends across said housing below said bottom pan and said bottom pan includes a central hole intersecting said discharge passage between said external passage and said discharge port.

* * * * *